US005797151A

United States Patent [19]

Ko

[11] Patent Number: 5,797,151

[45] Date of Patent: Aug. 25, 1998

[54] ASSEMBLY STRUCTURE OF A COMBINATION FAUCET

[75] Inventor: Hsi-Chia Ko, Changhua Hsien, Taiwan

[73] Assignee: Chung Cheng Faucet Co., Ltd., Changhua Hsien, Taiwan

[21] Appl. No.: 905,043

[22] Filed: Aug. 1, 1997

[51] Int. Cl.[6] ..... E03C 1/04

[52] U.S. Cl. ..... 4/677; 4/676; 137/801

[58] Field of Search ..... 4/675, 676, 677, 4/678; 137/801

[56] References Cited

U.S. PATENT DOCUMENTS

| | | | |
|---|---|---|---|
| 1,293,003 | 2/1919 | Bergens | 4/677 X |
| 4,552,171 | 11/1985 | Farrell et al. | 4/677 X |
| 5,027,851 | 7/1991 | Drees et al. | 4/675 X |
| 5,165,121 | 11/1992 | McTargett et al. | 4/678 |

*Primary Examiner*—Robert M. Fetsuga
*Attorney, Agent, or Firm*—Browdy and Neimark

[57] ABSTRACT

An improved assembly structure for a combination faucet of single knob or double knobs comprises a tap body and a water discharging pipe to be mounted to the interior of a housing to which a base plate is further applied at the bottom. The water discharging pipe is provided with a water spout at one end and a locking plate at the other end corresponding to a fixing plate disposed at an engaging seat of the tap body. The fixing plate has a circular hole disposed at the middle section and a protruding flange defining the periphery of the circular hole thereof. Two screw holes are disposed at both side of the circular hole and the protruding flange. The locking plate has a stepped hole defining the middle interior thereof corresponding to the circular hole and protruding flange of the fixing plate. Two through holes are disposed at both sides of the stepped hole matching to the screw holes thereof. A leaking-proof ring washer is adapted to be led through the protruding flange and be abutted tightly against the larger step of the stepped hole after the fixing plate and locking plate are screwed up via screw holes and through holes so as to provide a secure assembly of the water discharging pipe and the tap body. In addition, the water spout of the water discharging pipe is extended to be directed right downwards to come out through a slot of the base plate and be covered with a filter cap at the mouth. In case of different housing used, one needs only to change a new water discharging pipe to suit the new housing without altering the whole assembly.

3 Claims, 4 Drawing Sheets

ASSEMBLY STRUCTURE OF A COMBINATION FAUCET

BACKGROUND OF THE INVENTION

The present invention is related to an improved assembly structure of a combination faucet, especially to an assembly structure for use of a combination faucet of a single knob or double knobs, having a tap body and a water discharging pipe mounted to the interior of a housing to which a base plate is further applied at the bottom. The water discharging pipe is provided with a water spout at one end and a locking plate at the other end corresponding to a fixing plate of the tap body. The fixing plate has a circular hole and a protruding flange defining the periphery of the circular hole at the middle section, and the locking plate has a stepped hole defining the middle interior matching to the circular hole and protruding flange of the fixing plate. Via a leaking-proof ring washer being led through the protruding flange of the fixing plate and abutted closely against the larger step of the stepped hole when the fixing plate and the locking plate are screwed up by screw holes and through holes, the water discharging pipe can be securely attached to the tap body with the water spout being led through a slot of the base plate and directed right downwards at the mouth.

A conventional assembly structure of a combination faucet of single knob or double knobs usually falls into two different ways. The water discharging pipe and the tap body of a conventional assembly are assembled either by welding or by screw thread. For one, the water discharging pipe is directly welded onto the front plane of the tap body. In process of welding, the water spout of the water discharging pipe may be swerved from its position and thus unable the water discharging pipe to be properly assembled to the housing. In addition, the welding may change the metal construction of the pipe, causing the transformation of the pipe and thus the difficulty of the assembly of the pipe. For the other, in case of screw thread, both tap body and water discharging pipe of a conventional combination faucet are provided with either inner thread or outer thread respectively corresponding to each other. In assembly, the water discharging pipe is first applied with adhesive agent at one end before the end of the pipe having outer thread being matched to the inner thread of the tap body. To secure the water discharging pipe tightly onto the tap body, the water spout of the water discharging pipe may easily be swerved from its correct direction, and to adjust the water spout back to its position by force, the water discharging pipe or the tap body may also be burst broken. It thus causes many difficulties in assembly. In addition, when different housings are used, both water discharging pipe and the tap body have to be inconveniently changed to suit the new housing.

SUMMARY OF THE PRESENT INVENTION

It is therefore the primary object of the present invention to provide an improved assembly structure for use in a combination faucet of single knob or double knobs, comprising a tap body and a water discharging pipe mounted to a housing to which a base plate is applied at the bottom; wherein the tap body and the water discharging pipe can be easily and securely assembled via a fixing plate and a locking plate with a water spout of the water discharging pipe being led through a slot of the base plate and directed right downwards at the mouth.

It is another object of the present invention to provide an improved assembly structure of a combination faucet wherein in case of different housings used, one needs only to change a new water discharging pip to suit the new housing without altering the tap body.

DETAILED DESCRIPTION OF THE PREFERRED EMBODIMENTS

Figure 1:
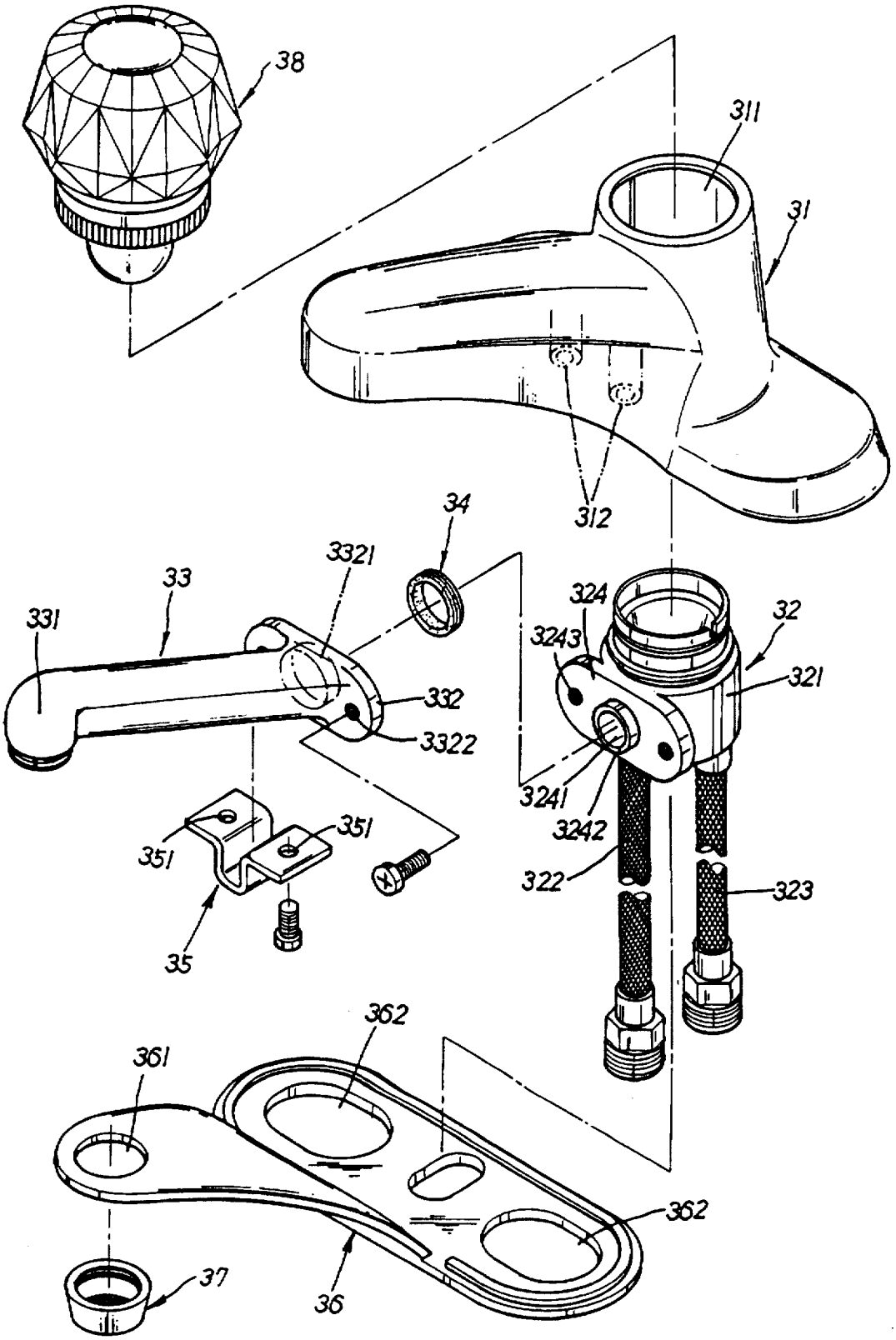
FIG. 1 is a perspective exploded view of a combination faucet of single knob of the present invention.

Please refer to FIG. 1. The present invention is related to an improved assembly structure of a combination faucet, especially to an assembly structure for use in a combination faucet of single knob, having a housing 31, a tap body 32, a water discharging pipe 33, a leaking-proof ring washer 34, a securing means 35, a base plate 36, a filter cap 37, and a knob 38.

Figure 2:
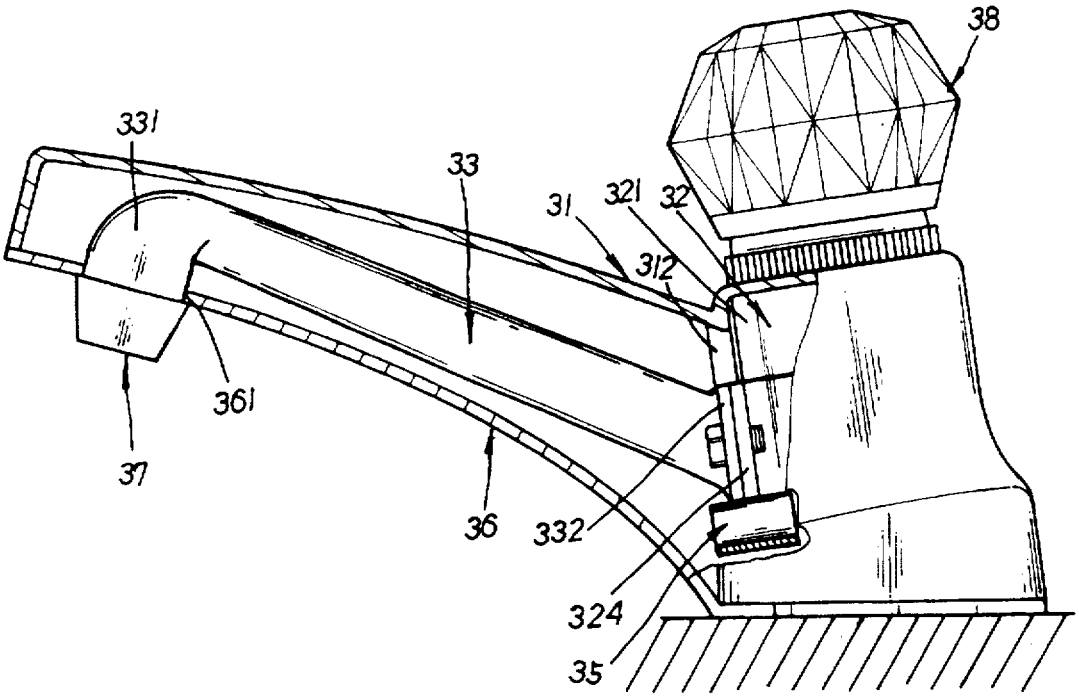
FIG. 2 is an assembled sectional view of the combination faucet of FIG. 1.

A central cavity 311 is disposed at the rear end of the housing 31 thereof and two fixing posts 312 each having thread groove disposed thereon are disposed at the interior front top in front of the central cavity 311 thereof. The tap body 32 is provided with an engaging seat 321 to the bottom of which a hot and a cold water influx tubes 322, 323 are connected respectively. A fixing plate 324 is disposed at the front plane of the engaging seat 321 thereof, having a circular hole 3241 and a protruding flange 3242 defining the periphery of the circular hole 3241 disposed at the middle section of the fixing plate 324 thereof. In addition, screw holes 3243 are arranged at both sides of the circular hole 3241 and the protruding flange 3242 thereof respectively. A water spout 331 is disposed at one end of the water discharging pipe 33 and a locking plate 332 is extended at the other end of the water discharging pipe 33 thereof The locking plate 332 is provided with a stepped hole 3321 defining the interior middle section thereof and two through holes 3322 each arranged at one side of the stepped hole 3321 thereof respectively. In addition, both lateral sides of the securing means 35 are provided with a locking hole 351 respectively. The base plate 36 defines out a shape corresponding to the bottom plane of the housing 31, having a slot 361 disposed at the top end of the front section and a left and a right through holes 362 disposed at both lateral sides of the rear section thereof Please refer to FIG. 2. In assembly of a combination faucet of single knob of the present invention, the leaking-proof ring washer 34 is first led through the protruding flange 3242 of the fixing plate 324 of the tap body 32. The locking plate 332 of the water discharging pipe 33 is juxtaposed and engaged with the fixing plate 324 by the front plane, abutting the leaking-proof ring washer 34 tightly against the larger step of the stepped hole 3321 thereof Screws are then adapted to secure the locking plate 332 of the water discharging pipe 33 fixedly onto the fixing plate 324 of the tap body 32 via the through holes 3322 of the locking plate 332 and the screw holes 3243 of the fixing plate 324 thereof In addition, the water discharging pipe 33 is extended forwards in a straight line at the front of the engaging seat 321 of the tap body 32 with the water spout 331 of the water discharging pipe 33 being directed right downwards at the mouth. The engaged tap body 22 and the water discharging pipe 33 are then mounted from bottom to top into the interior of the housing 31 with the upper section of the engaging seat 321 of the tap body 32 protruding right through the central cavity 311 of the housing 31. The securing means 35 is then adapted to abut against the front bottom end of the engaging seat 321 of the tap body 32 and fix the engaged tap body 32 and the water discharging pipe 33 onto of the housing 31 via screws being passed through the locking holes 351 of the securing means 35 and the fixing posts 312 of the housing 31. The knob 38 is screwed up at the top of the engaging seat 321 of the tap body 32, further securing the tap body 32 and the water discharging pipe 33 at the interior of the housing 31. Finally, the base plate 25 is fixed to the bottom flange of the housing 31 with the water spout 331 of the water discharging pipe 331 being led right through the slot 361 of the base plate 36 at the front section and the hot and cold water tubes 322, 323 disposed at the bottom of the engaging seat 321 of the tap body 32 coming out through the left and right through holes 362 at the rear section thereof. Finally, the filter cap 37 is applied to cover the mouth of the water spout 331 to complete the assembly of the present invention as shown in FIG. 2.

Figure 4:
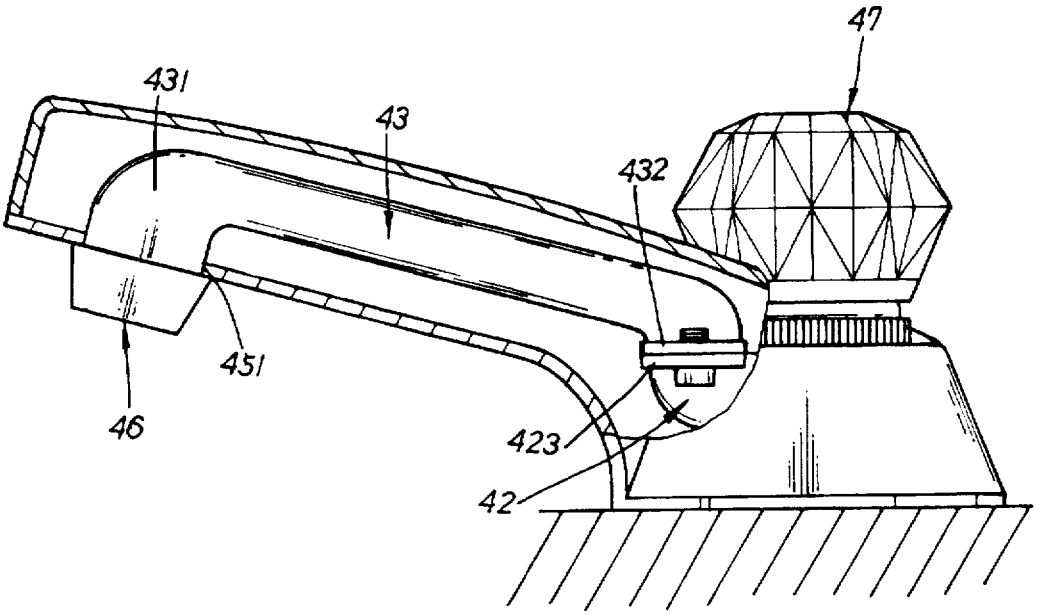
FIG. 4 is an assembled sectional view of the combination faucet of FIG. 3.
Figure 3:
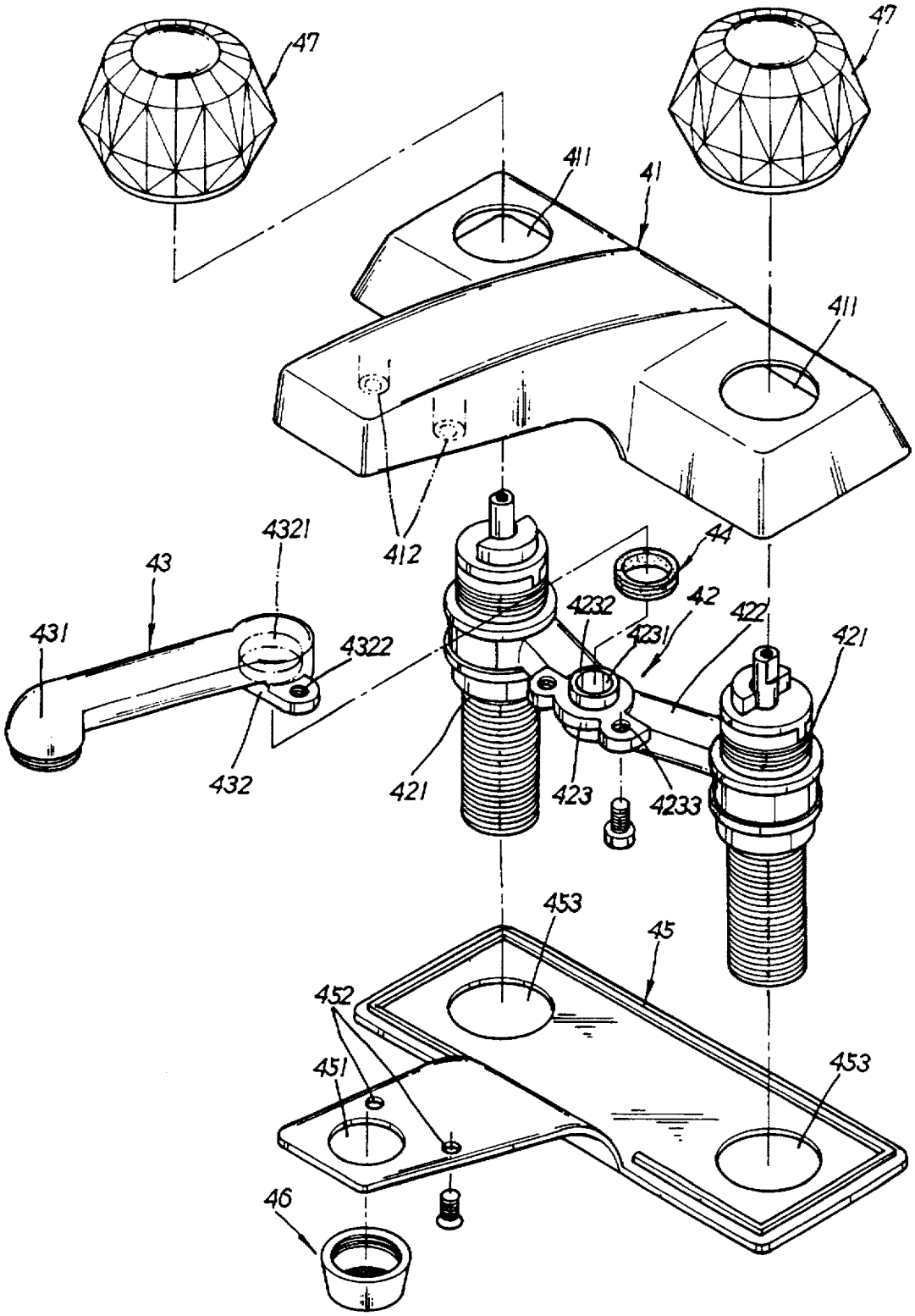
FIG. 3 is a perspective exploded view of a combination faucet of double knobs of the present invention.

Please refer to FIG. 3 showing another embodiment of the present invention. The present invention is related to an improved assembly structure of a combination faucet, especially to the assembly structure of a combination faucet of double knobs as shown in FIG. 3, comprising a housing 41, a tap body 42, a water discharging pipe 43, a leaking-proof ring washer 44, a base plate 45, a filter cap 46, and two knobs 47. The housing 41 is provided with a left and a right cavities 411 at both lateral sides of the rear section and two fixing posts 412 each having thread groove disposed thereon at the interior top of the front section thereof. The tap body 42 is made up of two engaging seats 421 communicated with each other at the upper section through a V-shaped linking pipe 422. At the top middle section of the V-shaped linking pipe 422 is transversely disposed a fixing plate 423. The fixing plate 423 has a circular hole 4231 with a protruding flange 4232 defining the periphery of the circular hole 4231 disposed at the middle section thereof and two screw holes 4233 arranged at both sides of the circular hole 4231 thereof. The water discharging pipe 43 is provided with a water spout 431 at the front end and a locking plate 432 transversely disposed at the rear bottom end of the water discharging pipe 43 thereof. The locking plate 432 has a stepped hole 4321 disposed at the middle section and two through holes 4322 arranged at both sides of the stepped hole 4321 thereof. The base plate 45 defines the similar shape of the bottom plane of the housing 41, having a left and a right through holes 453 disposed at both lateral side of the rear section and a slot 451 with two screw holes 452 disposed at the front top end thereof Please refer to FIG. 4. In assembly, the leaking-proof ring washer 44 is first led through the protruding flange 4232 of the fixing plate 423 thereof. The locking plate 432 of the water discharging pipe 43 is transversely put from above the fixing plate 423 of the tap body 42, abutting the leaking-proof ring washer 44 within the larger step of the stepped hole 4321 thereof. Two screws are adapted to secure the locking plate 432 of the water discharging pipe 43 fixedly onto the fixing plate 423 of the tap body 42 thereof via the screw holes 4322 of the fixing plate 432 and the through holes 4233 of the locking plate 423 thereof. Consequently, the water discharging pipe 43 is fixedly connected to the middle section of the V-shaped linking tube 422 of the tap body 42 at one end with the water spout 431 being directed right downwards at the other end. The engaged tap body 42 and the water discharging pipe 43 are then mounted from bottom to top into the housing 41 with both engaging seats 421 of the tap body 42 coming out through the left and right cavities 411 of the housing 41. The two knobs 47 are screwed up at the upper section of the engaging seats 421 respectively, further securing the tap body 42 and the water discharging pipe 43 at the interior of the housing 41. The base plate 45 is then fixed to the bottom flange of the housing 41 with the water spouts 431 of the water discharging pipe 43 being led through the slot 451 of the base plate 45 and both lower sections of the engaging seats 421 of the tap body 42 coming out through the left and right through holes 543 of the base plate 45 respectively. Screws are further adapted to be passed through the through holes 452 of the base plate 45 and secured to the fixing posts 412 of the housing 41 so as to further connect the base plate 45 with the housing 41 thereof. Finally, the filter cap 46 is applied to cover the mouth of the water spout 431 so as to complete the assembly of the present invention.

Figure 5:
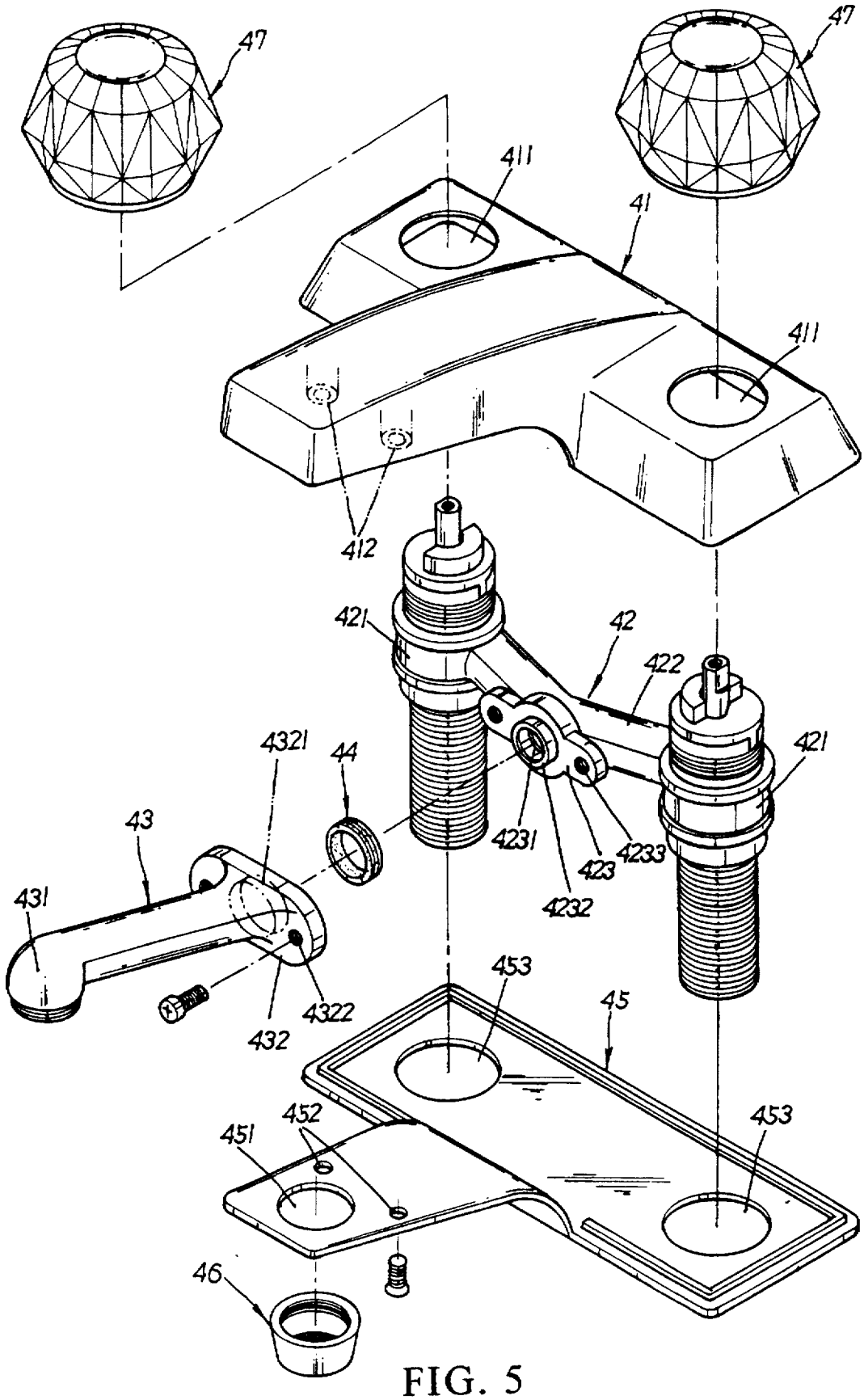
FIG. 5 is a perspective exploded view showing another embodiment of the combination faucet of double knobs of the present invention.

Please refer to Fig.5 showing a third embodiment of the present invention. The fixing plate 423 of the tap body 42 of the combination faucet of double knots as shown in FIG. 3 can also be vertically connected to the middle front plane of the V-shaped linking pipe 422 of the tap body 42. Accordingly, the locking plate 432 of the water discharging pipe 43 is also vertically disposed at the rear end of the water discharging pipe 43 so as to be matched to the fixing plate 423 to complete the assembly of the present invention above.

Thus, the embodiments of the present invention have several advantages. For one, the water discharging pipes 33, 43 can be easily and quickly assembled onto the tap bodies 32, 42 with the water spouts 331, 431 being directed downwardly right at the mouths. For the other, in case of different housing 41 used in assembly of a combination faucet of double knots, one needs only to change a new water discharging pipe 43 suited without altering the tap body 42.

What is claimed is:

1. An improved assembly structure of a combination faucet, comprising a housing, a tap body, a water discharging pipe, a leaking-proof ring washer, a fixing means, a base plate, a filter cap, and a knob; wherein the housing being provided with a central cavity at the rear section and two locking posts having thread groove thereon at the interior front top thereof; the tap body being comprised of an engaging seat having a cold and a hot water pipes attached at the bottom and a fixing plate disposed at the front plane; the water discharging pipe having a water spout disposed at the front end and a locking plate disposed at the rear end; the fixing means having two locking holes disposed at both lateral sides respectively; the base plate defining a similar shape of the bottom plane of the housing being provided with a slot at the front top thereof and a left and a right through holes at the rear lateral sides thereof, whereby, the engaged tap body and the water discharging pipe can be mounted onto the interior of the housing, and be further secured via the fixing means and the knob before the base plate is fixed to the bottom flange of the housing and the filter cap applied onto the water spout; said improved assembly of the combination faucet of single knob is characterized by that;

said fixing plate being provided with a circular hole at the middle section and a protruding flange defining the periphery of the circular hole; in addition, two screw holes being arranged at both side of said circular hole and said protruding flange;

said locking plate having a stepped hole defining the interior middle section thereof corresponding to the circular hole and the protruding flange of said fixing plate, and two through holes arranged at both sides of said stepped hole matching to said screw holes of said fixing plate;

whereby, the water discharging pipe is securely engaged with the tap body via said fixing plate and said locking plate; said leaking-proof ring washer being first led through s aid protruding flange of said fixing plate, said locking plate being then screwed up to said fixing plate right at the front via the through holes and the screw holes respectively, abutting said leaking-proof ring washer right into the larger step of said stepped hole of said locking plate, and permitting said water spout of the water discharging pipe being directed right downwards to come out through the slot of said base plate and be covered with said filter cap at the mouth.

2. The improved assembly structure of a combination faucet as claimed in claim 1 wherein the assembly structure comprises a housing, a tap body, a water discharging pipe, a leaking-proof ring washer, a base plate, a filter cap and two knobs; said housing having a left and a right cavities disposed at both rear lateral sides and two fixing posts disposed at the interior front top end; said tap body having two engaging seats communicated with each other through a V-shaped linking pipe; said water discharging pipe having a water spout at the front end, said base plate defining a similar shape of the bottom plane of the housing being providing with a slot and two screw holes at the front section and a left and a right slots at the rear section thereof, whereby said water discharging pipe is capable of being engaged with said tap body, the engaged tap body and the water discharging pipe being mounted to the interior of the housing and further secured via said two knobs screwed up to the top end of the engaging seats of the tap body, the base plate being joined to the bottom flange of the housing, and the filter cap being applied to cover the water spout of the water discharging pipe; said improved assembly of a combination faucet of double knots being characterized by that;

said V-shaped linking pipe is transversely provided with a fixing plate at the middle top plane; said fixing plate being provided with a circular hole at the middle section and a protruding flange defining the periphery of said circular hole; two screw holes being disposed at both sides of said circular holes and said protruding flange;

a locking plate is transversely disposed at the rear bottom end of said water discharging pipe corresponding to said fixing plate; said locking plate being provided with a stepped hole at the interior middle section and two through holes being arranged at both sides of said stepped hole;

whereby, said water discharging pipe is engaged with said V-shaped tube of said tap body via said fixing plate and said locking plate; the leaking-proof ring washer being first led through the protruding flange of the fixing plate is abutted tightly against the larger step of the stepped hole of the locking plate after said locking plate being applied and screwed up onto the top plane of said fixing plate; consequently, the water spout is extended to be directed downwards right at the mouth, and in case of different housing used, one needs only to change a new water discharging pipe to suit the case.

3. The improved assembly structure of a combination faucet as claimed in claim 1 wherein said fixing plate can be vertically disposed at the middle front plane of said V-shaped linking pipe matching to said locking plate of said water discharging pipe correspondingly disposed vertically at the rear end of said water discharging pip.

* * * * *